US009346290B2

(12) United States Patent
Tanaka et al.

(10) Patent No.: US 9,346,290 B2
(45) **Date of Patent: *May 24, 2016**

(54) IMAGE RECORDING APPARATUS

(71) Applicant: SEIKO EPSON CORPORATION, Shinjuku-ku (JP)

(72) Inventors: Toshio Tanaka, Shiojiri (JP); Kazuhito Hori, Azumino (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/802,824

(22) Filed: Jul. 17, 2015

(65) Prior Publication Data

US 2015/0321489 A1 Nov. 12, 2015

Related U.S. Application Data

(63) Continuation of application No. 14/224,950, filed on Mar. 25, 2014, now Pat. No. 9,114,637.

(30) Foreign Application Priority Data

Mar. 29, 2013 (JP) ..... 2013-071597

(51) Int. Cl.
*B41J 2/01* (2006.01)
*B41J 11/00* (2006.01)
*B41J 13/00* (2006.01)

(52) U.S. Cl.
CPC ..... *B41J 11/002* (2013.01); *B41J 13/0009* (2013.01)

(58) Field of Classification Search
CPC ..... B41J 11/002
USPC ..... 347/102
See application file for complete search history.

(56) References Cited

U.S. PATENT DOCUMENTS 9,114,637 B2 * 8/2015 Tanaka ..... B41J 11/002
2012/0287214 A1 11/2012 Fujisawa

FOREIGN PATENT DOCUMENTS

| | | |
|---|---|---|
| JP | 2004-167917 | 6/2004 |
| JP | 2004-284141 | 10/2004 |
| JP | 2004-314585 | 11/2004 |
| JP | 2011-067964 | 4/2011 |
| JP | 2012-236295 | 12/2012 |

* cited by examiner

*Primary Examiner* — Julian Huffman
*Assistant Examiner* — Sharon A Polk
(74) *Attorney, Agent, or Firm* — Workman Nydegger

(57) ABSTRACT

A first irradiation section has a light source and an emitting member. The light source generates radiation, and the emitting member is located between a first irradiation point and a virtual plane that extends through the edge of a nozzle surface closest to the first irradiation section tangentially to a curved surface. The radiation generated by the light source goes out through the emitting member. A control section controls a transportation speed in such a manner that ink dots formed at a dot formation point should move to the first irradiation point in a second time period that is equal to or shorter than a first time period. The first time period is the time period from the time immediately after the ink dots are formed to the time when the diameter of the ink dots reaches twice the nozzle pitch.

4 Claims, 7 Drawing Sheets

INK DOTS FORMED

FIRST TIME PERIOD HAS PASSED

FIG. 4

| USE | ABBREVIATION | NAME | % BY MASS |
|---|---|---|---|
| POLYMERIZABLE COMPOUND (VINYL-ETHER-CONTAINING (METH)ACRYLATE) | VEEA | 2-(2-VINYLOXYETHOXY) ETHYL ACRYLATE (TRADE NAME OF A Nippon Shokubai Co., Ltd. PRODUCT) | 20.0 |
| POLYMERIZABLE COMPOUND (MONOFUNCTIONAL (METH)ACRYLATE) | PEA | VISCOAT #192 (PHENOXYETHYL ACRYLATE) (TRADE NAME OF AN OSAKA ORGANIC CHEMICAL INDUSTRY LTD. PRODUCT) | 40.0 |
| POLYMERIZABLE COMPOUND (MULTIFUNCTIONAL (METH)ACRYLATE) | DPGDA | NK ESTER APG-100 (DIPROPYLENE DIGLYCOL DIACRYLATE) (TRADE NAME OF A SHIN-NAKAMURA CHEMICAL CO., LTD. PRODUCT) | 18.1 |
| POLYMERIZABLE COMPOUND (MULTIFUNCTIONAL (METH)ACRYLATE) | A-DPH | A-DPH (DIPENTAERYTHRITOL HEXAACRYLATE) (TRADE NAME OF A SHIN-NAKAMURA CHEMICAL CO., LTD. PRODUCT) | 8.0 |
| PHOTOPOLYMERIZATION INITIATOR | Irgacure819 | IRGACURE 819 (TRADE NAME OF A BASF PRODUCT, 100% SOLIDS) | 3.0 |
| PHOTOPOLYMERIZATION INITIATOR | DarocurTPO | DAROCURTPO (TRADE NAME OF A CIBA SPECIALTY CHEMICALS PRODUCT) | 5.0 |
| PHOTOPOLYMERIZATION INITIATOR | Speedcure DTEX | Speedcure DETX (TRADE NAME OF A Lambson PRODUCT, 100% SOLIDS) | 2.5 |
| LEVELING AGENT (SURFACTANT) | BYK UV3500 | BYK-UV3500 (TRADE NAME OF A BYK PRODUCT) | 0.5 |
| DISPERSANT | SOL32000 | Solsperse 32000 (TRADE NAME OF A LUBRIZOL PRODUCT) | 1.0 |
| BLACK PIGMENT | CB | MICROLITH-WA Black C-WA (BLACK PIGMENT (C.I. PIGMENT BLACK 7); TRADE NAME OF A BASF PRODUCT) | 1.9 |
| | TOTAL | | 100.0 |

| DISTANCE FROM DOT FORMATION POINT [mm] | 0 | 10 | 50 | 100 | 250 |
|---|---|---|---|---|---|
| TIME TO IRRADIATION [msec] | 0 | 20 | 100 | 200 | 500 |
| SUBSTRATE A, LINE WIDTH [μm] | 40 | 70 | 93 | 100 | 110 |
| SUBSTRATE B, LINE WIDTH [μm] | 40 | 50 | 58 | 60 | 65 |

| DISTANCE FROM DOT FORMATION POINT [mm] | 0 | 10 | 50 | 100 | 250 |
|---|---|---|---|---|---|
| TIME TO IRRADIATION [msec] | 0 | 20 | 100 | 200 | 500 |
| SUBSTRATE A, LINE WIDTH [μm] | 40 | 70 | 93 | 100 | 110 |
| SUBSTRATE B, LINE WIDTH [μm] | 40 | 50 | 58 | 60 | 65 |
| SUBSTRATE A+PINNING, LINE WIDTH [μm] | 40 | 70 | 80 | 82 | 87 |
| SUBSTRATE C, LINE WIDTH [μm] | 40 | 75 | 100 | 110 | 120 |
| SUBSTRATE C+PINNING, LINE WIDTH [μm] | 40 | 75 | 85 | 87 | 92 |

IMAGE RECORDING APPARATUS

CROSS-REFERENCE TO RELATED APPLICATIONS

This application is a continuation application of U.S. patent application Ser. No. 14/224,950, filed Mar. 25, 2014, which patent application is incorporated herein by reference in its entirety. U.S. patent application Ser. No. 14/224,950 claims the benefit of and priority to Japanese Patent Application No. 2013-071597, filed Mar. 29, 2013, the contents of which are hereby incorporated by reference in its entirety.

BACKGROUND

1. Technical Field

The present invention relates to an image recording apparatus that discharges a radiation-curable ink to form ink dots on a recording medium and cures the ink dots by irradiation so that an image formed by the ink dots will be fixed to the recording medium.

2. Related Art

An ink jet recording apparatus that uses an ultraviolet-curable ink is known as a representative example of this type of image recording apparatus as described in, for example, JP-A-2004-284141 (e.g., FIG. 2 and FIG. 4). Such an ink-jet-recording image recording apparatus discharges droplets of ink through a nozzle provided to a head. The discharged ink droplets make contact with the surface of a recording medium and form ink dots, and then the ink dots spread on the surface of the recording medium. This means that adjacent dots can overlap to a great extent and different colors can be mixed, i.e., what is called bleeding can occur, if the spread of the applied ink is not restricted. Bleeding affects the image quality and also constitutes a main cause of thickened lines. Thus, the ability of ultraviolet-curable ink to cure upon exposure to ultraviolet radiation is used in order that ink dots on the surface of a recording medium should be cured and fixed to the recording medium before spreading farther than necessary.

Irradiating the surface of a recording medium with ultraviolet radiation in such a way requires an ultraviolet irradiation unit. Furthermore, it is needed to irradiate ink dots with ultraviolet radiation before the ink dots spread. From these viewpoints, the above image recording apparatus has an ultraviolet irradiation unit located relatively close to a head. However, the use of this configuration without additional measures can cause clogging as a result of ultraviolet radiation reaching the ejection opening of a nozzle provided to the head and curing the ink existing in the ejection opening. Clogging affects the image quality and is also an obstacle to stable image recording. To solve this problem, the device described in JP-A-2004-284141 has an ultraviolet irradiation unit and a head disposed with the distance between the ultraviolet irradiation unit and the head in a certain range so that ultraviolet radiation should be prevented from reaching the head (an ultraviolet prevention technology).

The device described in JP-A-2004-284141 discharges an ultraviolet-curable ink from a head while transporting a recording medium in a horizontal position with an endless belt stretched between two transport rollers. Another image recording mode is based on the use of a platen drum as described in, for example, JP-A-2011-67964 (FIG. 1). The image recording apparatus described in JP-A-2011-67964 discharges an ultraviolet-curable ink onto the surface of a recording medium wrapped around a platen drum while transporting the recording medium in the direction of the circumference of the platen drum. The ultraviolet prevention technology used in JP-A-2004-284141 cannot be directly applied to this type of apparatus, in which a recording medium is bent while being irradiated with ultraviolet radiation. It is therefore desired to provide a radiation prevention technology suitable for image recording apparatus that record an image with radiation-curable ink, such as ultraviolet-curable ink, while holding up a recording medium with a supporting member that has a curved surface, such as a drum.

SUMMARY

An advantage of an aspect of the invention is that an image recording apparatus is provided that allows the user to record a high-quality image with a radiation-curable ink in a stable manner using a supporting member that has a curved surface to hold up a recording medium.

An image recording apparatus according to an aspect of the invention has a supporting member, a head, a first irradiation section, and a control section. The supporting member has a curved surface and transports a recording medium in a transport direction while holding up a principal surface of the recording medium with the curved surface. The head has a nozzle surface that has a plurality of ejection openings that are arranged with a certain nozzle pitch and from which a radiation-curable ink is discharged. The head discharges a radiation-curable ink from the ejection openings with the nozzle surface facing another principal surface of the recording medium held up by the curved surface so that the radiation-curable ink should reach the recording medium and form ink dots. The first irradiation section irradiates the ink dots with first radiation and cures the ink dots at a first irradiation point. The first irradiation point is located downstream of a dot formation point, i.e., the point at which the ink dots are formed, in the transport direction with a certain distance from the dot formation point. The control section controls the transportation speed of the recording medium transported by the supporting member. The first irradiation section has a light source that generates the first radiation and an aperture that defines the reach of the first radiation emitted from the light source out of the first irradiation section. The aperture is located on the supporting member side with respect to a virtual plane that extends through the edge of the nozzle surface closest to the first irradiation section tangentially to the curved surface. When the time period from a time immediately after the ink dots are formed to the time when the diameter of the ink dots reaches twice the nozzle pitch is defined as a first time period, the control section controls the transportation speed in such a manner that the ink dots formed at the dot formation point should move to the first irradiation point in a second time period equal to or shorter than the first time period.

In this aspect of the invention having such a structure, a recording medium is transported in the transport direction while being held up by the curved surface of the supporting member. After the head discharges a radiation-curable ink to form ink dots on the recording medium at the dot formation point, the ink dots move to the first irradiation point as the recording medium is transported, and then the ink dots are cured by irradiation with radiation from the first irradiation section. Exposure of the nozzle surface of the head to the radiation emitted during this irradiation process can cause the ejection openings to clog up. In this aspect of the invention, however, the radiation is prevented from reaching the nozzle surface with the use of the curved surface the supporting member has. More specifically, the following placement condition is satisfied: the aperture of the first irradiation section through which radiation is emitted should be located between the aforementioned virtual plane and the first irradiation point. As a result, the nozzle surface is hidden behind the curved surface of the supporting member when viewed from the aperture, and the radiation emitted toward the nozzle surface is blocked by the curved surface of the supporting member. This ensures that the radiation is prevented from reaching the nozzle surface.

When the second time period, i.e., the length of time required for ink dots formed at the dot formation point to move to the first irradiation point, exceeds the first time period, adjacent ink dots overlap to a great extent, causing defects such as bleeding and thickened lines. In this aspect of the invention, however, the transportation speed is controlled so that the following transportation speed condition is satisfied: the second time period should be equal to or shorter than the first time period. As a result, the aforementioned defects are prevented from occurring.

Therefore an aspect of the invention, which satisfies the placement and transportation speed conditions specified above, allows the user to record a high-quality image with a radiation-curable ink in a stable manner using a supporting member that has a curved surface to hold up the recording medium.

The image recording apparatus may additionally have a second irradiation section. Such a second irradiation section is located at a second irradiation point downstream of the dot formation point in the transport direction with a certain distance from the dot formation point and upstream of the first irradiation point in the transport direction with a certain distance from the first irradiation point and emits radiation whose irradiance is ⅕ or less of the irradiance of the radiation emitted from the first irradiation section. In this case, the ink dots are irradiated in two stages. More specifically, the ink dots are temporarily cured with a relatively small integral dose and then fully cured with a relatively large integral dose. Adding such a temporary curing process extends the first time period and allows for a greater freedom of choice in the first irradiation point, the transportation speed, and so forth, thereby increasing the degree of freedom in apparatus design.

In order that irradiating the ink dots at the first irradiation point should be enough to stop the ink dots from spreading and finish fixation, it is desirable that the configuration of the first irradiation section is such that the light source be controlled in such a manner that the integral dose of the radiation given to the ink dots during the second time period is equal to or more than the integral dose required to stop the ink dots from spreading on the recording medium. The supporting member can be, for example, a cylindrical drum.

BRIEF DESCRIPTION OF THE DRAWINGS

The invention will be described with reference to the accompanying drawings, wherein like numbers reference like elements.

FIG. 4 presents the composition of an ink used to examine changes in line width.

DESCRIPTION OF EXEMPLARY EMBODIMENTS

Figure 1A:
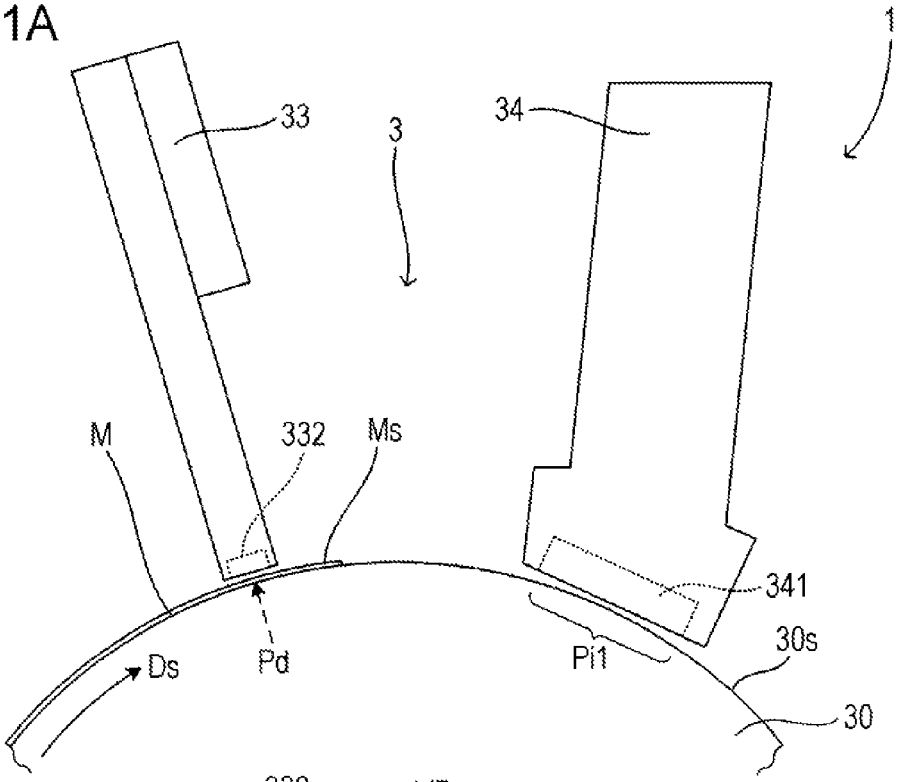
FIGS. 1A to 1D illustrate some main components of Embodiment 1 of an image recording apparatus according to an aspect of the invention.
Figure 1B:
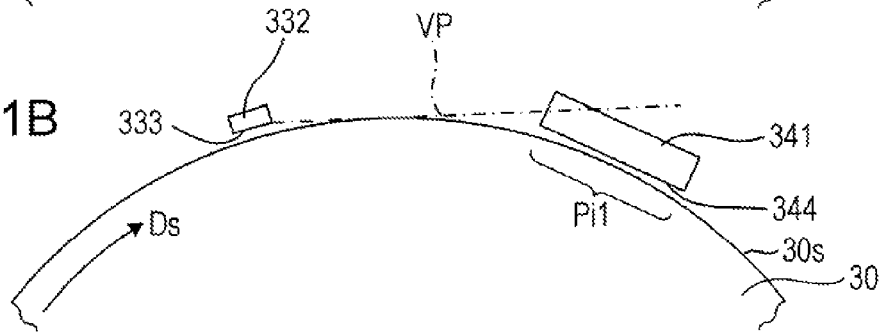

FIGS. 1A to 1D illustrate some main components of a printer that is Embodiment 1 of an image recording apparatus according to an aspect of the invention. FIG. 2 is a block diagram that schematically illustrates an electrical system that controls the printer in FIGS. 1A to 1D. The printer 1 records an image on a single sheet M (a web) and, like the apparatus described in JP-A-2011-67964, has a feeding section where the sheet M stored in a rolled form is fed by means of a feeding motor 21 (FIG. 2), a processing section 3 where an image is recorded on the sheet M fed out of the feeding section, and a roll-up section where the sheet M carrying the recorded image is rolled up by means of a roll-up motor 41, although not illustrated in FIGS. 1A to 1D. In the processing section 3, the sheet M fed out of the feeding section is transported in a predetermined transport direction Ds by means of a platen drum 30 with the sheet M held up by the platen drum 30. The image is recorded on the sheet M by a plurality of recording heads and a plurality of ultraviolet irradiation units arranged along the circumference of the platen drum 30. The basic structure of an image recording apparatus according to Embodiment 1 is therefore similar in large part to that of the apparatus described in JP-A-2011-67964. However, the former is quite different from the latter because the former is, as described below, based on a unique radiation prevention technology with which the ultraviolet radiation emitted from the ultraviolet irradiation units is prevented from reaching the recording heads located adjacent to the ultraviolet radiation units. The following describes this image recording apparatus with the focus on structures and operations relevant to the radiation prevention technology.

The processing section 3 includes anterior and posterior drive rollers (not illustrated) located before and after the platen drum 30, respectively. In this section the sheet M transported from the anterior drive roller to the posterior drive roller is held up by the platen drum 30, and an image is recorded on the sheet M. The anterior drive roller has a plurality of small projections formed by thermal spraying on the circumferential surface so that the sheet M fed out of the feeding section can be wrapped therearound. The anterior drive roller is coupled to an anterior drive motor 31 (FIG. 2). As the anterior drive motor 31 operates in response to an operation command received from a printer control section 200 that controls the entire printer 1, the anterior drive roller rotates in a predetermined direction and transports the sheet M fed out of the feeding section downstream in the transport direction Ds.

The platen drum 30 is rotatably held by a supporting mechanism (not illustrated) and is, for example, a cylindrical drum that has a diameter of 400 [mm]. The sheet M transported from the anterior drive roller to the posterior drive roller is wrapped around the platen drum 30 with the back side facing the platen drum 30. The platen drum 30 holds up the sheet M from the back side while the frictional force that acts between the platen drum 30 and the sheet M rotates the platen drum 30 in the direction Ds of the transportation of the sheet M.

The posterior drive roller, like the anterior drive roller, has a plurality of small projections formed by thermal splaying on the circumferential surface so that the sheet M transported from the platen drum 30 can be wrapped therearound. The posterior drive roller is coupled to a posterior drive motor 32 (FIG. 2). As the posterior drive motor 32 operates in response to an operation command received from the printer control section 200, the posterior drive roller rotates in a predetermined direction and transports the sheet M, which carries the recorded image, to the roll-up section.

In this embodiment, therefore, the sheet M can be transported in the transport direction Ds with the back side held up by the platen drum 30, and it is possible to adjust the transportation speed of the sheet M by controlling the anterior drive motor 31 and the posterior drive motor 32 by means of the printer control section 200. As a result, it is possible to control the length of time required to transport the sheet M from a dot formation point to an ultraviolet irradiation point by adjusting the sheet transportation speed. The term "dot formation point" refers to the point where the recording heads 33 discharge an ultraviolet-curable ink and form ink dots to record an image on the surface of the sheet M as described below. The term "ultraviolet irradiation point" refers to the point where the ink dots on the sheet M are cured by irradiation with ultraviolet radiation and stopped from spreading on the sheet M, i.e., the point where the ink is fixed.

Figure 1C:
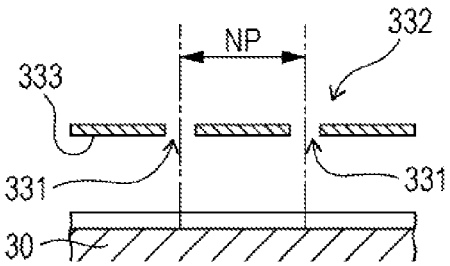
Figure 2:
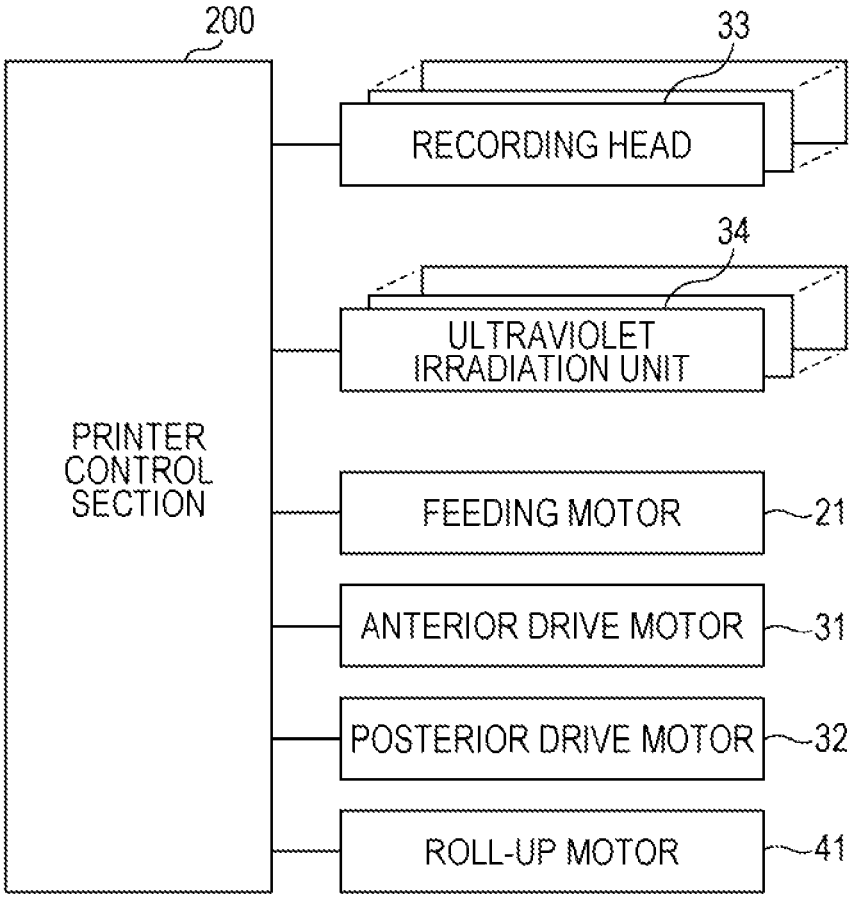
FIG. 2 is a block diagram that schematically illustrates an electrical system that controls the printer in FIGS. 1A to 1D.

Although FIG. 1A illustrates a single recording head 33, the processing section 3 in Embodiment 1 actually has a plurality of recording heads 33 for different colors arranged in the transport direction Ds in the order of colors so that a color image can be recorded on the surface of the sheet M. As illustrated in FIG. 1C, each recording head 33 has a plurality of nozzles 332 that discharge droplets of ink from ejection openings 331. Each nozzle 332 has a nozzle surface 333 that has a plurality of ejection openings 331 arranged with a fixed pitch NP, and each recording head 33 is positioned in such a manner that the nozzle surface 333 should face, with a small clearance, the surface of the sheet M wrapped around the platen drum 30. The recording head 33 discharges ink from the ejection openings 331 by an ink jet process, and the discharged ink reaches the surface Ms of the sheet M transported in the transport direction Ds and forms ink dots at the dot formation point Pd.

Figure 1D:
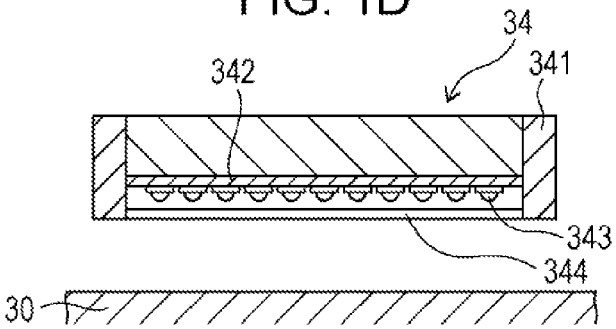

Each ink is an UV (ultraviolet) ink (light-curable ink), i.e., an ink that cures upon exposure to ultraviolet radiation (light). As illustrated in FIG. 1A, the processing section 3 in Embodiment 1 has a single ultraviolet irradiation unit 34 with which the inks are cured and fixed to the sheet M. However, it is also possible to provide two or more ultraviolet irradiation units 34. In some cases the process of curing ink includes two stages, i.e., temporary curing and full curing, as described in JP-A-2011-67964. In Embodiment 1, however, the inks are fully cured at once, and thus the integral dose of the ultraviolet radiation from the ultraviolet irradiation unit 34 is relatively high. The term "fully cured" as used herein does not simply mean that the ink is completely cured and also includes situations where ink dots discharged onto a recording medium no longer spread on the recording medium. Likewise, the term "temporarily cured" refers to situations where two ink dots discharged onto a recording medium so as to overlap with each other are cured to such an extent that no bleeding will occur. More specifically, the ultraviolet irradiation unit 34 has an emitter body 341 in the end portion thereof on the platen drum 30 side as illustrated in FIG. 1D. The emitter body 341 contains a plurality of light-emitting elements (a light source) 343 attached to the bottom surface of a substrate 342 and also contains drivers (not illustrated) that drive the light-emitting elements 343 attached to the top surface of the substrate 342. Examples of devices that can be used as the light-emitting elements 343 include mercury lamps, metal halide lamps, excimer lasers, ultraviolet lasers, cold-cathode tubes, hot-cathode tubes, black lights, and LEDs (light-emitting diodes). The emitter body 341 also has an aperture and a transparent optical member 344 in the lower end portion thereof. The aperture defines the reach of the ultraviolet radiation emitted from the light-emitting elements 343 out of the unit, and the transparent optical member 344 is a material that is attached to cover the aperture and allows ultraviolet radiation to pass through, e.g., a coverslip or a lens. The aperture is defined by, for example, a covering member that covers the light-emitting elements 343 and a transparent-optical-member-supporting member, i.e., a supporting member that holds up the transparent optical member 344. The ultraviolet irradiation unit 34 is positioned in such a manner that the transparent optical member 344 should face, with a small clearance, an ultraviolet irradiation point on the surface of the sheet M wrapped around the platen drum 30. When the light-emitting elements 343 emit ultraviolet radiation in response to an activation command received from the printer control section 200, therefore, the ultraviolet radiation goes out through the transparent optical member 344 and cures ink on the sheet M at the ultraviolet irradiation point. The ultraviolet irradiation unit 34 can be activated at any time. In order that at least the ink should be fully cured and stopped from spreading at the ultraviolet irradiation point, however, it is needed to ensure that the total irradiance of ultraviolet radiation given to the ink while the ink approaches the ultraviolet irradiation point and while the ink is at the ultraviolet irradiation point, i.e., the integral dose, is as high as required to stop the ink dots from spreading. It is desirable to consider these factors in controlling the integral dose of ultraviolet radiation at the ultraviolet irradiation point.

In this embodiment an aperture is used to limit the reach of the ultraviolet radiation emitted out of the ultraviolet irradiation unit 34 as described above. However, the ultraviolet radiation from the ultraviolet irradiation unit 34 may reach a recording head 33, depending on the placement condition of the ultraviolet irradiation unit 34. For example, placing the ultraviolet irradiation unit 34 farther from the platen drum 30 than is a virtual plane VP (see FIG. 1B) that extends through the edge of the nozzle surface 333 closest to the ultraviolet irradiation unit 34 tangentially to the surface (curved surface) 30*s* of the platen drum 30 can cause the ejection openings 331 of the nozzles 332 to clog up as a result of the ultraviolet radiation emitted from the ultraviolet irradiation unit 34 reaching the nozzle surface 333 and curing the ink existing in the ejection openings 331. In contrast, placing the ultraviolet irradiation unit 34 closer to the platen drum 30 than is the virtual plane VP reliably prevents ultraviolet radiation from reaching the nozzle surface 333. Hence in this embodiment the ultraviolet irradiation unit 34 is positioned in such a manner that the aperture is located between the virtual plane VP and the platen drum 30. The use of such a configuration therefore allows for blocking of ultraviolet radiation from entering a recording head 33. In the case where no covering member or transparent-optical-member-supporting member is provided, i.e., when the light-emitting elements 343 are exposed, the light-emitting elements 343 are placed closer to the platen drum 30 than is the virtual plane VP. Unfortunately, simply using this structure can cause reduced image quality. Hence in this embodiment the transportation speed of the sheet M satisfies a certain transportation speed condition as well as the above placement condition. The following describes this transportation speed condition with reference to FIGS. 1A to 1D and FIGS. 3A and 3B.

Figure 3A:
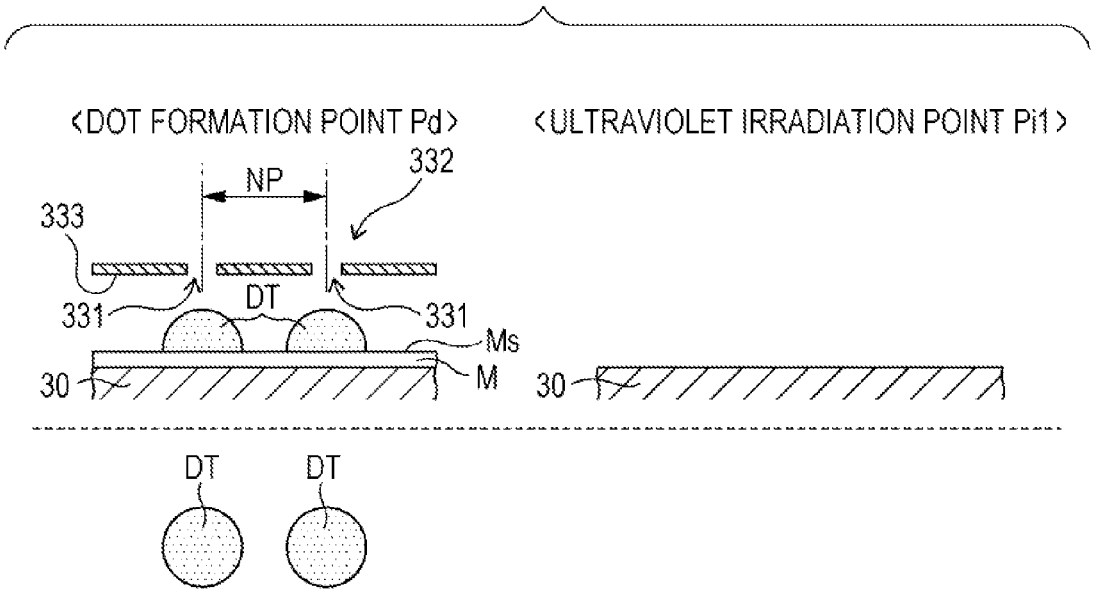
FIGS. 3A and 3B schematically illustrate an image formation operation the printer in FIGS. 1A to 1D carries out.
Figure 3B:
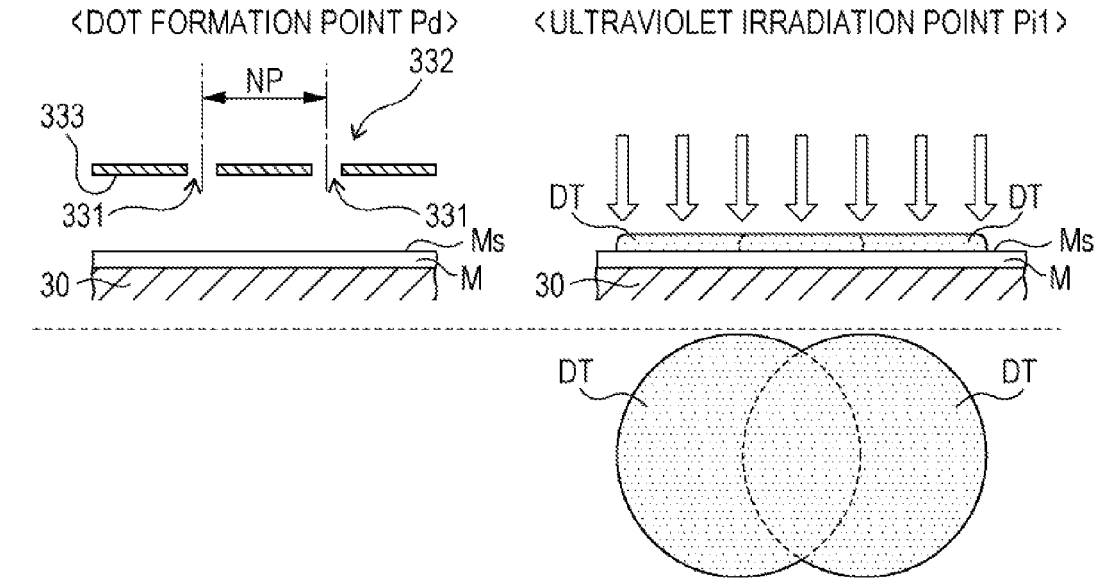

FIGS. 3A and 3B schematically illustrate an image formation operation the printer in FIGS. 1A to 1D carries out. In these figures, the drawings in the upper one of the two panels divided by a broken line are schematic cross-sectional views, whereas the drawing in the lower panel is schematic plan views of the sheet M and the drum surface 30*s* seen from above.

In this embodiment, droplets of ink are discharged from ejection openings 331, reach the surface Ms of the sheet M, and form ink dots DT at a dot formation point Pd. Immediately after dot formation, the ink dots DT are at a distance corresponding to the nozzle pitch NP from each other as illustrated in FIG. 3A. For example, when an image is formed with a resolution of 600 [dpi], the nozzle pitch NP is set at approximately 42 [μm], and the dot pitch between the ink dots DT is also 42 [μm] upon dot formation. Then the ink that makes up the ink dots DT spreads on the surface Ms of the sheet M, gradually increasing the diameter of the ink dots DT, until the ink dots DT on the sheet M transported in the transport direction Ds reach the ultraviolet irradiation point Pi1. For example, in FIG. 3B, the ink dots DT are transported from the dot formation point Pd to the ultraviolet irradiation point Pi1 over a first time period T1 from the time when the ink dots DT are formed. At the ultraviolet irradiation point Pi1, the diameter of the ink dots DT is twice the nozzle pitch NP. Although adjacent ink dots DT partially overlap, this degree of overlap does not lead to noticeable image deterioration due to defects such as ink bleeding and thickened lines and is generally acceptable. If the degree of overlap exceeds this, it is noticeable that image deterioration has occurred.

Hence in this embodiment the printer control section 200 controls the anterior drive motor 31 and the posterior drive motor 32 in such a manner that the length of time T required for the ink dots DT formed at the dot formation point Pd to move to the ultraviolet irradiation point Pi1 (hereinafter referred to as "time to irradiation T") is equal to or shorter than the aforementioned first time period T1. This prevents image deterioration caused by excessive overlap of adjacent ink dots DT before curing by ultraviolet irradiation. In the case where the diameter of the ink dots DT formed at the dot formation point Pd is smaller than the nozzle pitch NP, it is desirable to control the transportation speed in such a manner that the diameter of the ink dots DT should become equal to the nozzle pitch NP, i.e., adjacent ink dots DT should be joined together, before the ink dots DT reach the ultraviolet irradiation point Pi1.

In this embodiment, therefore, ink dots DT are formed at a dot formation point Pd while a sheet M is transported with the sheet M held up by the circumferential surface of a platen drum 30 that has a cylindrically curved surface and the above transportation speed condition satisfied, and an ultraviolet irradiation unit 34 positioned to satisfy the aforementioned placement condition irradiates the ink dots DT with ultraviolet radiation at a first ultraviolet irradiation point Pi1 to cure the ink dots DT. As a result of satisfying placement and transportation speed conditions in this way, this embodiment allows the user to record a high-quality image in a stable manner.

The way that ink dots DT spread on the surface Ms of the sheet M may vary depending on the kind of ink or sheet used. The kinds of sheets M are roughly divided into paper sheets and film sheets. Specific examples of paper sheets include bond paper, cast-coated paper, art paper, and coated paper, and specific examples of film sheets include synthesized paper, PET (polyethylene terephthalate), and PP (polypropylene). The ultraviolet-curable inks are usually compositions such as the one described below. In the following description, the term "(meth)acrylate" refers to at least one of an acrylate and the corresponding methacrylate, and "(meth)acrylic" refers to at least one of acrylic and methacrylic.

In the following description, the term "curability" refers to an ability to polymerize and cure upon exposure to light in the presence or absence of a photopolymerization initiator. The term "discharge stability" refers to an ability to always discharge uniform ink droplets from a nozzle without clogging up the nozzle.

Polymerizable Compound

A polymerizable compound contained in an ink composition used in this embodiment polymerizes by the action of a photopolymerization initiator (described hereinafter) upon exposure to ultraviolet light. As a result, ink dots formed on the sheet M are cured.

Monomer A

Monomer A, an essential polymerizable compound in this embodiment, is a (meth)acrylate that contains a vinyl ether group. Monomer A is represented by general formula (I):

$$CH^2{=}CR^1{-}COOR^2{-}O{-}CH{=}CH{-}R^3 \quad (I)$$

(where $R^1$ is a hydrogen atom or a methyl group, $R^2$ is a divalent organic residue that contains 2 to 20 carbon atoms, and $R^3$ is a hydrogen atom or a monovalent organic residue that contains 1 to 11 carbon atoms).

Monomer A contained in the ink composition provides the ink composition with good curability.

Examples of preferred groups for use as $R^2$ in general formula (I), i.e., a divalent organic residue that contains 2 to 20 carbon atoms, include linear, branched, or cyclic alkylene groups that contain 2 to 20 carbon atoms, alkylene groups that contain 2 to 20 carbon atoms and have an oxygen atom derived from an ether bond and/or an ester bond in the structure, and substituted or unsubstituted divalent aromatic groups that contain 6 to 11 carbon atoms. In particular, the following groups are preferred: alkylene groups that contain 2 to 6 carbon atoms, such as ethylene, n-propylene, isopropylene, and butylene groups; and alkylene groups that contain 2 to 9 carbon atoms and have an oxygen atom derived from an ether group in the structure, such as oxyethylene, oxy-n-propylene, oxyisopropylene, and oxybutylene groups.

Examples of preferred groups for use as $R^3$ in general formula (I), i.e., a monovalent organic residue that contains 1 to 11 carbon atoms, include linear, branched, or cyclic alkyl groups that contain 1 to 10 carbon atoms and substituted or unsubstituted aromatic groups that contain 6 to 11 carbon atoms. In particular, the following groups are preferred: alkyl groups that contain 1 or 2 carbon atoms, i.e., methyl and ethyl groups; and aromatic groups that contain 6 to 8 carbon atoms, such as phenyl and benzyl groups.

When such an organic residue is a group that may be substituted, the substituents are divided into groups that contain one or more carbon atoms and groups that contain no carbon atoms. When a substituent is a group that contains one or more carbon atoms, these carbon atoms are included in the number of carbon atoms in the organic residue. Examples of carbon-containing groups include, but are not limited to, carboxyl and alkoxy groups. Examples of groups that contain no carbon atoms include, but are not limited to, hydroxyl and halo groups.

Examples of compounds that can be used as Monomer A include, but are not limited to, the following: 2-vinyloxyethyl (meth)acrylate, 3-vinyloxypropyl(meth)acrylate, 1-methyl-2-vinyloxyethyl(meth)acrylate, 2-vinyloxypropyl(meth) acrylate, 4-vinyloxybutyl(meth)acrylate, 1-methyl-3-vinyloxypropyl(meth)acrylate, 1-vinyloxymethylpropyl (meth)acrylate, 2-methyl-3-vinyloxypropyl(meth)acrylate, 1,1-dimethyl-2-vinyloxyethyl(meth)acrylate, 3-vinyloxybutyl(meth)acrylate, 1-methyl-2-vinyloxypropyl(meth)acrylate, 2-vinyloxybutyl(meth)acrylate, 4-vinyloxycyclohexyl(meth)acrylate, 6-vinyloxyhexyl(meth)acrylate, 4-vinyloxymethylcyclohexylmethyl(meth)acrylate, 3-vinyloxymethylcyclohexylmethyl(meth)acrylate, 2-vinyloxymethylcyclohexylmethyl(meth)acrylate, p-vinyloxymethylphenylmethyl(meth)acrylate, m-vinyloxymethylphenylmethyl(meth)acrylate, o-vinyloxymethylphenylmethyl(meth)acrylate, 2-(vinyloxyethoxy)ethyl(meth)acrylate, 2-(vinyloxyisopropoxy)ethyl(meth)acrylate, 2-(vinyloxyethoxy)propyl(meth)acrylate, 2-(vinyloxyethoxy)isopropyl(meth)acrylate, 2-(vinyloxyisopropoxy)propyl(meth)acrylate, 2-(vinyloxyisopropoxy)isopropyl(meth)acrylate, 2-(vinyloxyethoxyethoxy)ethyl(meth)acrylate, 2-(vinyloxyethoxyisopropoxy)ethyl(meth)acrylate, 2-(vinyloxyisopropoxyethoxy)ethyl(meth)acrylate, 2-(vinyloxyisopropoxyisopropoxy)ethyl(meth)acrylate, 2-(vinyloxyethoxyethoxy)propyl(meth)acrylate, 2-(vinyloxyethoxyisopropoxy)propyl(meth)acrylate, 2-(vinyloxyisopropoxyethoxy)propyl(meth)acrylate, 2-(vinyloxyisopropoxyisopropoxy)propyl(meth)acrylate, 2-(vinyloxyethoxyethoxy)isopropyl(meth)acrylate, 2-(vinyloxyethoxyisopropoxy)isopropyl(meth)acrylate, 2-(vinyloxyisopropoxyethoxy)isopropyl(meth)acrylate, 2-(vinyloxyisopropoxyisopropoxy)isopropyl(meth)acrylate, 2-(vinyloxyethoxyethoxyethoxy)ethyl(meth)acrylate, 2-(vinyloxyethoxyethoxyethoxyethoxy)ethyl(meth)acrylate, 2-(isopropenoxyethoxy)ethyl(meth)acrylate, 2-(isopropenoxyethoxyethoxy)ethyl(meth)acrylate, 2-(isopropenoxyethoxyethoxyethoxy)ethyl(meth)acrylate, 2-(isopropenoxyethoxyethoxyethoxyethoxy)ethyl(meth)acrylate, polyethylene glycol monovinyl ether(meth)acrylate, and polypropylene glycol monovinyl ether(meth)acrylate.

In particular, it is preferred to use 2-(vinyloxyethoxy)ethyl (meth)acrylate, i.e., at least one of 2-(vinyloxyethoxy)ethyl acrylate and 2-(vinyloxyethoxy)ethyl methacrylate, more preferably 2-(vinyloxyethoxy)ethyl acrylate, because these compounds have low viscosity, a high ignition point, and excellent curability. Examples of 2-(vinyloxyethoxy)ethyl (meth)acrylates include 2-(2-vinyloxyethoxyl)ethyl(meth)acrylate and 2-(1-vinyloxyethoxyl)ethyl(meth)acrylate, and examples of 2-(vinyloxyethoxy)ethyl acrylates include 2-(2-vinyloxyethoxyl)ethyl acrylate (hereinafter also referred to as "VEEA") and 2-(1-vinyloxyethoxyl)ethyl acrylate.

Examples of processes for producing Monomer A include, but are not limited to, the following: esterifying (meth)acrylic acid with a hydroxyl-containing vinyl ether (Process B); esterifying a halogenated (meth)acrylic acid with a hydroxyl-containing vinyl ether (Process C); esterifying (meth)acrylic anhydride with a hydroxyl-containing vinyl ether (Process D); transesterifying a (meth)acrylate with a hydroxyl-containing vinyl ether (Process E); esterifying (meth)acrylic acid with a halogen-containing vinyl ether (Process F); esterifying a (meth)acrylic acid-alkali (alkaline-earth) metal salt with a halogen-containing vinyl ether (Process G); transvinylating a hydroxyl-containing (meth)acrylate with vinyl carboxylic acid (Process H); and transetherifying a hydroxyl-containing (meth)acrylate with an alkyl vinyl ether (Process I).

Polymerizable Compounds Other than Monomer A

Besides the above vinyl-ether-containing (meth)acrylate (Monomer A), various known monomers and oligomers, including monofunctional, bifunctional, and multifunctional (having three or more functional groups) compounds, can be used (hereinafter referred to as "additional polymerizable compounds"). Examples of such monomers include the following: unsaturated carboxylic acids such as (meth)acrylic acid, itaconic acid, crotonic acid, isocrotonic acid, and maleic acid; salts of such unsaturated carboxylic acids; esters, urethanes, amides, and anhydrides derived from such unsaturated carboxylic acids; acrylonitrile, styrene, and various unsaturated polyesters, unsaturated polyethers, unsaturated polyamides, and unsaturated urethanes. As for oligomers, examples include oligomers made up of the monomers listed above, such as linear acrylic oligomers, and epoxy(meth)acrylate, oxetane(meth)acrylate, aliphatic urethane(meth)acrylates, aromatic urethane(meth)acrylates, and polyester (meth)acrylates.

Other monofunctional monomers and multifunctional monomers that may be contained include N-vinyl compounds. Examples of N-vinyl compounds include N-vinylformamide, N-vinylcarbazole, N-vinylacetamide, N-vinylpyrrolidone, N-vinylcaprolactam, acryloyl morpholine, and their derivatives.

Within additional polymerizable compounds, esters of (meth)acrylic acid, i.e., (meth)acrylates, are preferred.

Examples of monofunctional (meth)acrylates, within (meth)acrylates, include isoamyl(meth)acrylate, stearyl (meth)acrylate, lauryl(meth)acrylate, octyl(meth)acrylate, decyl(meth)acrylate, isomyristyl(meth)acrylate, isostearyl (meth)acrylate, 2-ethylhexyl-diglycol(meth)acrylate, 2-hydroxybutyl(meth)acrylate, butoxyethyl(meth)acrylate, ethoxydiethylene glycol(meth)acrylate, methoxydiethylene glycol(meth)acrylate, methoxypolyethylene glycol(meth)acrylate, methoxypropylene glycol(meth)acrylate, phenoxyethyl(meth)acrylate, tetrahydrofurfuryl(meth)acrylate, isobornyl(meth)acrylate, 2-hydroxyethyl(meth)acrylate, 2-hydroxypropyl(meth)acrylate, 4-hydroxybutyl(meth)acrylate, 2-hydroxy-3-phenoxypropyl(meth)acrylate, lactone-modified flexible (meth)acrylate, t-butyl cyclohexyl(meth)acrylate, dicyclopentanyl(meth)acrylate, and dicyclopentenyloxyethyl(meth)acrylate.

Examples of bifunctional (meth)acrylates, within (meth)acrylates, include triethylene glycol di(meth)acrylate, tetraethylene glycol di(meth)acrylate, polyethylene glycol di(meth)acrylate, dipropylene glycol di(meth)acrylate, tripropylene glycol di(meth)acrylate, polypropylene glycol di(meth)acrylate, 1,4-butanediol di(meth)acrylate, dicyclopentanyl di(meth)acrylate, 1,6-hexanediol di(meth)acrylate, 1,9-nonanediol di(meth)acrylate, neopentyl glycol di(meth)acrylate, dimethylol-tricyclodecane di(meth)acrylate, bisphenol A EO (ethylene oxide) adduct di(meth)acrylate, bisphenol A PO (propylene oxide) adduct di(meth)acrylate, hydroxypivalic acid neopentyl glycol di(meth)acrylate, polytetramethylene glycol di(meth)acrylate, and acrylic amine compounds obtained by reaction of 1,6-hexanediol di(meth)acrylate with an amine compound. Example of commercially available acrylic amine compounds obtained by reaction of 1,6-hexanediol di(meth)acrylate with an amine compound include EBECRYL 7100 (a compound that contains two amino groups and two acryloyl groups; a trade name of a Cytech, Inc. product)

Examples of multifunctional (meth)acrylates having three or more functional groups, within (meth)acrylates, include trimethylolpropane tri(meth)acrylate, EO-modified trimethylolpropane tri(meth)acrylate, pentaerythritol tri(meth)acrylate, isocyanuric acid EO-modified tri(meth)acrylate, pentaerythritol tetra(meth)acrylate, dipentaerythritol hexa(meth)acrylate, ditrimethylolpropane tetra(meth)acrylate, glycerol propoxy tri(meth)acrylate, caprolactone-modified trimethylolpropane tri(meth)acrylate, pentaerythritol ethoxy tetra(meth)acrylate, and caprolactam-modified dipentaerythritol hexa(meth)acrylate.

Preferably, the ink composition contains a monofunctional (meth)acrylate, in particular, as an additional polymerizable compound. This provides the ink composition with a low viscosity and allows additives such as a photopolymerization initiator to be highly soluble in the ink composition, as well as ensuring that discharge stability can be easily achieved. It is more preferred to use a monofunctional (meth)acrylate and a bifunctional (meth)acrylate in combination because this improves the toughness, heat resistance, and chemical resistance of ink coatings.

Furthermore, it is preferred that the monofunctional (meth) acrylate have one or more carbon skeletons selected from an aromatic ring skeleton, a saturated aliphatic ring skeleton, and an unsaturated aliphatic ring skeleton. The use of a monofunctional (meth)acrylate that has any of these skeletons as an additional polymerizable compound reduces the viscosity of the ink composition.

Examples of monofunctional (meth)acrylates that have an aromatic ring skeleton include phenoxyethyl(meth)acrylate and 2-hydroxy-3-phenoxypropyl(meth)acrylate. Examples of monofunctional (meth)acrylates that have a saturated aliphatic ring skeleton include isobornyl(meth)acrylate, t-butyl cyclohexyl(meth)acrylate, and dicyclopentanyl(meth)acrylate. Examples of monofunctional (meth)acrylates that have an unsaturated aliphatic ring skeleton include dicyclopentenyloxyethyl(meth)acrylate.

In particular, phenoxyethyl(meth)acrylate is preferred because the use of this compound reduces viscosity and odor.

The quantity of polymerizable compounds other than Monomer A is preferably in the range of 10% to 35% by mass based on the total mass (100% by mass) of the ink composition. Making the quantity of such additional polymerizable compounds fall within this range ensures excellent solubility of additives and excellent toughness, heat resistance, and chemical resistance of ink coatings.

One or a combination of two or more of such polymerizable compounds can be used.

Photopolymerization Initiators

Photopolymerization initiators contained in an ink composition used in this embodiment are used in order for the ink composition to cure and form a print on the surface of a recording medium through photopolymerization initiated by irradiation with ultraviolet light. The use of ultraviolet light (UV) ensures excellent safety and reduces the cost for the light-source lamp, compared to the use of other kinds of radiation.

As mentioned above, an acylphosphine photopolymerization initiator and a thioxanthone photopolymerization initiator are contained as such photopolymerization initiators. This provides the ink composition with excellent curability and prevents cured coatings from being colored soon after printing.

In addition to this, the total quantity of the acylphosphine photopolymerization initiator and the thioxanthone photopolymerization initiator is in the range of 9% to 14% by mass, preferably 10% to 13% by mass, more preferably 11% to 13% by mass, based on the total mass (100% by mass) of the ink composition. Making the total quantity of these initiators in the ink fall within these ranges provides the ink composition with extremely high curability and discharge stability. In particular, making the quantity of these initiators 9% by mass or more provides the ink composition with excellent discharge stability because a relatively high viscosity prevents mist, i.e., a cause of dirty images, from increasing.

Acylphosphine Photopolymerization Initiator

Photopolymerization initiators used in this embodiment include an acylphosphine photopolymerization initiator, or more specifically an acylphosphine-oxide-based photopolymerization initiator (hereinafter also simply referred to as "an acylphosphine oxide"). The use of an acylphosphine oxide provides the ink composition with excellent curability in particular, and also prevents cured coatings from being colored soon after printing and after some time has passed (i.e., reduces the initial pigmentation of cured coatings).

Examples of acylphosphine oxides include, but are not limited to, 2,4,6-trimethylbenzoyl-diphenylphosphine oxide, 2,4,6-triethylbenzoyl-diphenylphosphine oxide, 2,4,6-triphenylbenzoyl-diphenylphosphine oxide, bis(2,4,6-trimethylbenzoyl)-phenylphosphine oxide, and bis(2,6-dimethoxybenzoyl)-2,4,4-trimethylpentylphosphine oxide.

Examples of commercially available acylphosphine-oxide-based photopolymerization initiators include DAROCUR TPO (2,4,6-trimethylbenzoyl-diphenylphosphine oxide), IRGACURE 819 (bis(2,4,6-trimethylbenzoyl)-phenylphosphine oxide), and CGI 403 (bis(2,6-dimethoxybenzoyl)-2,4,4-trimethylpentylphosphine oxide).

Preferably, a monoacylphosphine oxide is contained as an acylphosphine oxide. A monoacylphosphine oxide is dissolved well when used as a photopolymerization initiator, and this ensures sufficient progress of cure. Furthermore, the use of a monoacylphosphine oxide provides the ink composition with excellent curability.

Examples of monoacylphosphine oxides include, but are not limited to, 2,4,6-trimethylbenzoyl-diphenylphosphine oxide, 2,4,6-triethylbenzoyl-diphenylphosphine oxide, and 2,4,6-triphenylbenzoyl-diphenylphosphine oxide. In particular, 2,4,6-trimethylbenzoyl-diphenylphosphine oxide is preferred.

Examples of commercially available monoacylphosphine oxides include DAROCUR TPO (2,4,6-trimethylbenzoyl-diphenylphosphine oxide).

Preferably, a photopolymerization initiator used in this embodiment is a monoacylphosphine oxide or a mixture of a monoacylphosphine oxide and a bisacylphosphine oxide. These oxides are highly soluble in the polymerizable compound, and the use of these oxides ensures excellent internal curability and reduced initial pigmentation of ink coatings.

Examples of bisacylphosphine oxides include, but are not limited to, bis(2,4,6-trimethylbenzoyl)-phenylphosphine oxide and bis(2,6-dimethoxybenzoyl)-2,4,4-trimethylpentylphosphine oxide. In particular, bis(2,4,6-trimethylbenzoyl)-phenylphosphine oxide is preferred.

The quantity of the acylphosphine oxide is preferably in the range of 8% to 11% by mass, more preferably 10% to 11% by mass, based on the total mass (100% by mass) of the ink composition. Making the quantity of the acylphosphine oxide fall within these ranges provides the ink composition with excellent curability and reduces the initial pigmentation of cured coatings.

Thioxanthone Photopolymerization Initiator

Photopolymerization initiators used in this embodiment include a thioxanthone photopolymerization initiator (hereinafter also simply referred to as "a thioxanthone"). The use of a thioxanthone provides the ink composition with excellent curability and, in particular, reduces the initial pigmentation of cured coatings.

In particular, 2,4-diethylthioxanthone is preferred over other thioxanthones because this compound sensitizes acylphosphine oxides and are highly soluble in the polymerizable compound and extremely safe.

Examples of commercially available thioxanthones include KAYACURE DETX-S (2,4-diethylthioxanthone) (a trade name of a Nippon Kayaku Co., Ltd. product), ITX (BASF), and Quantacure CTX (Aceto Chemical).

The quantity of the thioxanthone is preferably in the range of 1% to 3% by mass, more preferably 2% to 3% by mass, based on the total mass (100% by mass) of the ink composition. Making the quantity of the thioxanthone fall within these ranges provides the ink composition with excellent curability and reduces the initial pigmentation of cured coatings.

Examples of other photopolymerization initiators include Speedcure TPO (2,4,6-trimethylbenzoyl-diphenylphosphine oxide) and Speedcure DETX (2,4-diethylthioxanthen-9-one) (trade names of Lambson products).

Coloring Material

The ink composition used in this embodiment may contain coloring material. Such coloring material can be pigment.

Pigment

In this embodiment, the use of pigment as coloring material improves the light resistance of the ink composition. Such pigment can be an inorganic pigment or an organic pigment.

Examples of inorganic pigments that can be used include carbon blacks (C.I. Pigment Black 7) such as furnace black, lamp black, acetylene black, and channel black, iron oxide, and titanium oxide.

Examples organic pigments include azo pigments such as insoluble azo pigments, condensed azo pigments, azo lakes, and chelate azo pigments, polycyclic pigments such as phthalocyanine pigments, perylene and perinone pigments, anthraquinone pigments, quinacridone pigments, dioxane pigments, thioindigo pigments, isoindolinone pigments, and quinophthalone pigments, dye chelates (e.g., basic-dye chelates and acid-dye chelates), dye lakes (basic-dye lakes and acid-dye lakes), nitro pigments, nitroso pigments, aniline black, and daylight fluorescent pigments.

More specifically, examples of carbon blacks for black ink include the following: No. 2300, No. 900, MCF88, No. 33, No. 40, No. 45, No. 52, MA7, MA8, MA100, No. 2200B, etc. (trade names of Mitsubishi Chemical Corporation products); Raven 5750, Raven 5250, Raven 5000, Raven 3500, Raven 1255, Raven 700, etc. (trade names of Carbon Columbia products); Regal 400R, Regal 330R, Regal 660R, Mogul L, Monarch 700, Monarch 800, Monarch 880, Monarch 900, Monarch 1000, Monarch 1100, Monarch 1300, Monarch 1400, etc. (trade names of CABOT JAPAN K.K. products); and Color Black FW1, Color Black FW2, Color Black FW2V, Color Black FW18, Color Black FW200, Color Black 5150, Color Black 5160, Color Black S170, Printex 35, Printex U, Printex V, Printex 140U, Special Black 6, Special Black 5, Special Black 4A, Special Black 4, etc. (trade names of Degussa products).

Examples of pigments for white ink include C.I. Pigment White 6, 18, and 21. Metal-containing compounds that can be used as white pigment can also be used. For example, metal oxides commonly used as white pigment, barium sulfate, and calcium carbonate can be used. Examples of such metal oxides include, but are not limited to, titanium dioxide, zinc oxide, silica, alumina, and magnesium oxide.

Examples of pigments for yellow ink include C.I. Pigment Yellow 1, 2, 3, 4, 5, 6, 7, 10, 11, 12, 13, 14, 16, 17, 24, 34, 35, 37, 53, 55, 65, 73, 74, 75, 81, 83, 93, 94, 95, 97, 98, 99, 108, 109, 110, 113, 114, 117, 120, 124, 128, 129, 133, 138, 139, 147, 151, 153, 154, 155, 167, 172, and 180.

Examples of pigments for magenta ink include C.I. Pigment Red 1, 2, 3, 4, 5, 6, 7, 8, 9, 10, 11, 12, 14, 15, 16, 17, 18, 19, 21, 22, 23, 30, 31, 32, 37, 38, 40, 41, 42, 48 (Ca), 48 (Mn), 57 (Ca), 57:1, 88, 112, 114, 122, 123, 144, 146, 149, 150, 166, 168, 170, 171, 175, 176, 177, 178, 179, 184, 185, 187, 202, 209, 219, 224, and 245 and C.I. Pigment Violet 19, 23, 32, 33, 36, 38, 43, and 50.

Examples of pigments for cyan ink include C.I. Pigment Blue 1, 2, 3, 15, 15:1, 15:2, 15:3, 15:34, 15:4, 16, 18, 22, 25, 60, 65, and 66 and C.I. Vat Blue 4 and 60.

Examples of pigments other than magenta, cyan, and yellow pigments include C.I. Pigment Green 7 and 10, C.I. Pigment Brown 3, 5, 25, and 26, and C.I. Pigment Orange 1, 2, 5, 7, 13, 14, 15, 16, 24, 34, 36, 38, 40, 43, and 63.

One or a combination of two or more of such pigments can be used.

When such a pigment is used, the average particle diameter of the pigment is preferably 2 μm or less, more preferably in the range of 30 to 300 nm. When having an average particle diameter in these ranges, the pigment has better reliability in the ink composition, such as discharge stability and dispersion stability, than in other cases and also forms images with excellent quality. The average particle diameter mentioned herein is measured by dynamic light scattering.

The quantity of such coloring material is preferably in the range of 1.5% to 6% by mass for CMYK and 15% to 30% by mass for W based on the total mass (100% by mass) of the ink composition so that good color saturation can be achieved and that the interference of the coloring material itself with the curing of ink coatings through absorption of light can be reduced.

Dispersant

When an ink composition used in this embodiment contains pigment, the ink composition may further contain a dispersant to make the pigment more dispersible. Examples of dispersants include, but are not limited to, dispersants commonly used to prepare liquid pigment dispersion, such as polymeric dispersants. Specific examples include dispersants mainly composed of one or more of polyoxyalkylene polyalkylene polyamines, vinyl polymers and copolymers, acrylic polymers and copolymers, polyesters, polyamides, polyimides, polyurethanes, amino polymers, silicon-containing polymers, sulfur-containing polymers, fluorine-containing polymers, and epoxy resin.

Examples of commercially available polymeric dispersants include AJISPER dispersants manufactured by Ajinomoto Fine-Techno, Solsperse dispersants (e.g., Solsperse 36000 and Solsperse 32000, trade names) available from Lubrizol Corporation, DISPERBYK (trade name) dispersants manufactured by BYK Chemie, and DISPARLON (trade name) dispersants manufactured by Kusumoto Chemicals.

Leveling Agent

An ink composition used in this embodiment may further contain a leveling agent (a surfactant) to make the ink composition wet a printing substrate faster. Examples of leveling agents that can be used include, but are not limited to, silicone surfactants such as polyester-modified silicone and polyether-modified silicone. In particular, it is preferred to use polyether-modified polydimethylsiloxane or polyester-modified polydimethylsiloxane. Specific examples include BYK-347, BYK-348, BYK-UV3500, 3510, 3530, and 3570 (trade names of BYK Japan KK products).

Polymerization Inhibitor

An ink composition used in this embodiment may further contain a polymerization inhibitor that provides the ink composition with good storage stability. Examples of polymerization inhibitors that can be used include, but are not limited to, IRGASTAB UV10 and UV22 (trade names of BASF products) and Hydroquinone Monomethyl Ether (MEHQ, a trade name of a KANTO CHEMICAL CO., INC. product).

Other Additives

An ink composition used in this embodiment may contain additives (components) other than those mentioned above. Examples of such components may include, but are not limited to, known polymerization accelerators, penetration enhancers, moisturizing agents (humectants), and other additives. Examples of the "other additives" include known fixatives, antimolds, preservatives, antioxidants, ultraviolet absorbents, chelators, pH-adjusting agents, and thickeners.

Characteristics of an Ink Composition

An ink composition used in this embodiment preferably has a viscosity of 15 mPa·s or less, more preferably 9 to 14 mPa·s, at 20° C. When the viscosity at 20° C. is in these ranges, the photopolymerization initiators and other additives are highly soluble, and discharge stability can be easily achieved. The viscosity values provided herein are values measured with the use of MCR300 rheometer manufactured by DKSH Japan K.K. An ink composition used in this embodiment can be cured by irradiation with ultraviolet light that has a peak emission wavelength of 365 to 405 nm.

Figures 5A, 5B:
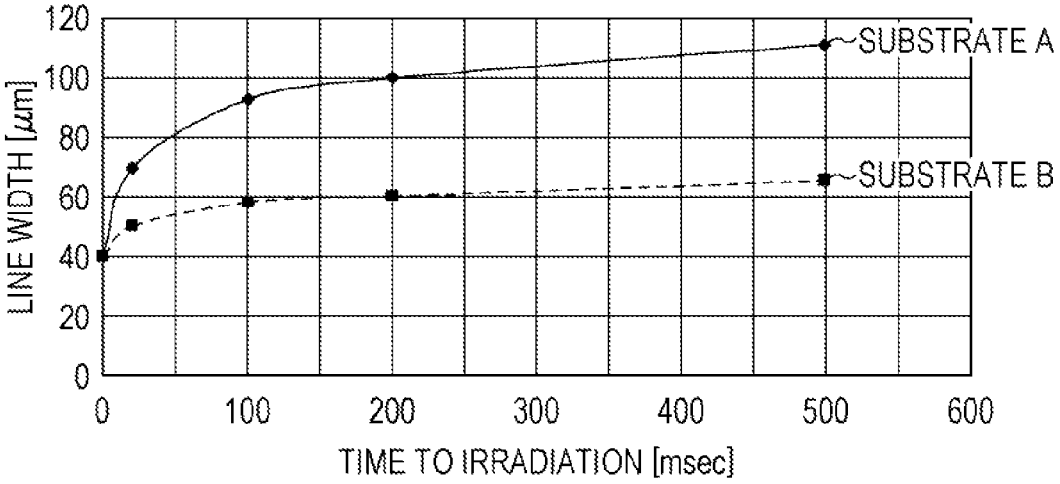
FIGS. 5A and 5B show a relationship between the spread of ink dots and substrates.

Dot lines were formed on each of two different kinds of sheets M with the use of one of ultraviolet-curable inks having such a composition (in this embodiment, a black ink having the composition given in FIG. 4), and changes in line width were examined. As shown in FIGS. 5A and 5B, it was found that the first time period T1 varies depending on the kind of sheet M. Representative two of commonly used substrates were used as the substrates for the sheets M in these drawings:

Substrate A . . . a PET substrate (Avery Dennison Fasson, 72825);

Substrate B . . . a PE substrate (Avery Dennison Fasson, 76911).

When the sheet M with the substrate A was used, ink dots formed on the sheet M were relatively likely to spread. The ink dots spread far beyond the nozzle pitch NP in a very short time (on the order of a few [msec]) from dot formation, and the first time period T1 (the length of time for the line width to increase to twice the nozzle pitch NP (=42 [μm]), i.e., 84 [μm]) was approximately 50 [msec]. In contrast, when the sheet M with the substrate B was used, ink dots spread less far. Although the ink dots spread beyond the nozzle pitch NP in a short time (approximately 20 [msec]) from dot formation, the line width did not reach twice the nozzle pitch NP during more than 500 [msec] of measurement and stopped increasing at approximately 65 [μm].

In this way, the mode of the spread of ink dots on a sheet M may vary depending on the kind of sheet M. However, it is possible to record an image with high quality in all cases by measuring the first time period T1 for each sheet beforehand in the way described above and selecting the shortest measurement as the aforementioned "time to irradiation T." The use of such a configuration allows for recording of images with excellent quality together with the prevention of nozzle clogging due to ultraviolet radiation regardless of the kind of the substrate the sheet M has. Note that since a color image is to be formed, the composition of ink varies between the colors, and the first time period T1 may also vary between the inks. This can also be overcome with the use of a configuration in which the inks used in the printer 1 are subjected to the measurement described above, an appropriate first time period T1 is selected, and the sheet M is transported at a transportation speed that matches the selected first time period T1.

Figure 6:
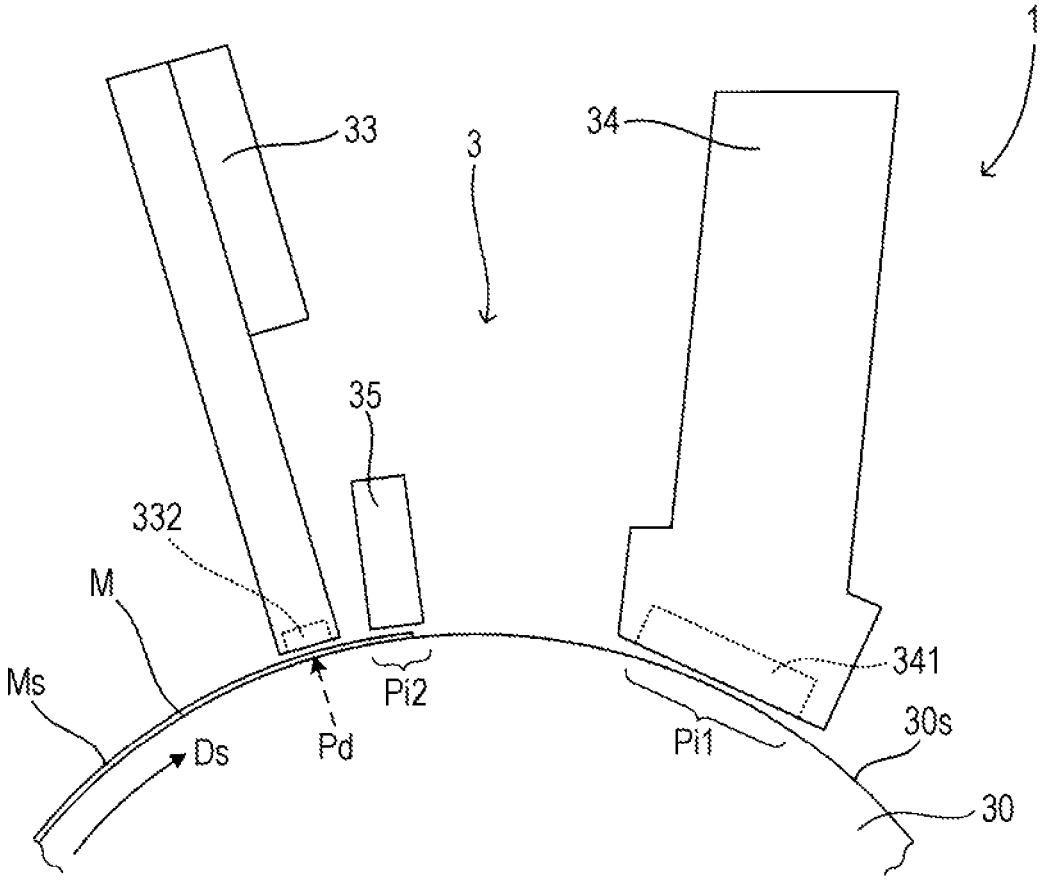
FIG. 6 illustrates some main components of Embodiment 2 of an image recording apparatus according to an aspect of the invention.

FIG. 6 illustrates some main components of Embodiment 2 (a printer) of an image recording apparatus according to an aspect of the invention. What makes Embodiment 2 very different from Embodiment 1 is that Embodiment 2 additionally has an ultraviolet irradiation unit 35 that irradiates ink dots on the sheet M with ultraviolet radiation at a point Pi2 between the dot formation point Pd and the ultraviolet irradiation point Pi1 in the transport direction Ds. In this embodiment, the ultraviolet irradiation unit 34 is referred to as "the first ultraviolet irradiation unit" and the point Pi1 at which ink dots are irradiated with ultraviolet radiation from this unit as "the first ultraviolet irradiation point," whereas the ultraviolet irradiation unit 35 is referred to as "the second ultraviolet irradiation unit" and the point Pi2 at which ink dots are irradiated with ultraviolet radiation from this unit as "the second ultraviolet irradiation point" so that the two points Pi1 and Pi2 can be distinguished and that the two ultraviolet irradiation units 34 and 35 can be distinguished.

The reason why two ultraviolet irradiation units 34 and 35 are provided in Embodiment 2 is that the inks are cured in two stages, i.e., temporary curing and full curing. More specifically, the second ultraviolet irradiation unit 35 irradiates ink dots DT with ultraviolet radiation such that the integral dose per unit area should be ⅕ or less of the integral dose of the first ultraviolet irradiation unit 34 in order that the inks are temporarily cured to such an extent that the ink dots DT do not lose their shape, rather than completely curing the ink dots DT and stopping the ink dots DT from spreading. Furthermore, even if the nozzle surface 333 of the recording heads 33 is exposed to the ultraviolet light emitted from the second ultraviolet irradiation unit 35, the nozzles work without clogging up during a certain operation duration because the integral dose is low. The first ultraviolet irradiation unit 34, as in Embodiment 1, irradiates ink dots DT with a high integral dose so that the ink dots DT will be fully cured.

Figures 7A, 7B:
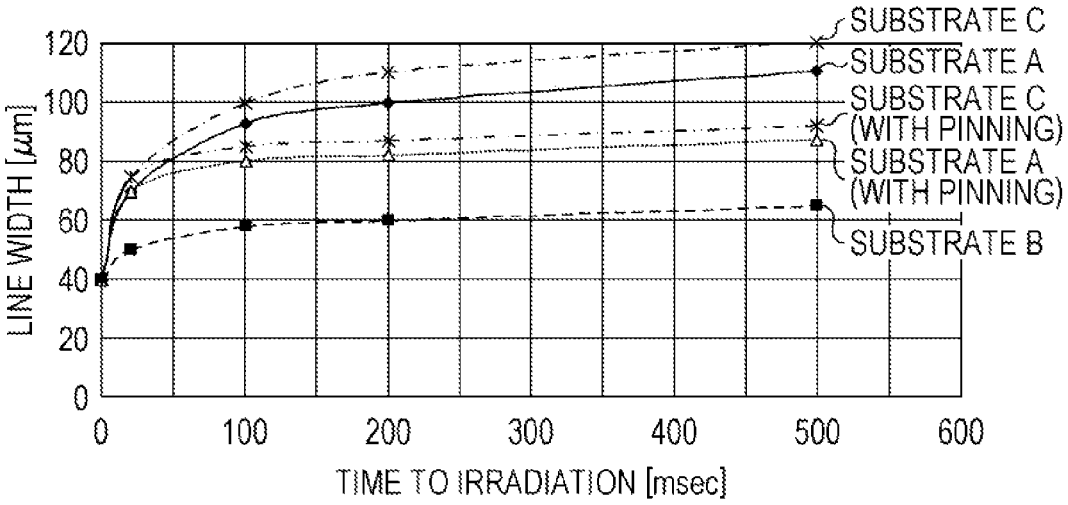
FIGS. 7A and 7B show relationships among pinning, the spread of ink dots, and substrates.

Temporarily curing the inks in this way, i.e., pinning, allows for a great extension of the first time period T1 as shown in FIGS. 7A and 7B. For example, the first time period T1 was 50 [msec] when a sheet M with the substrate A was subjected to full curing only (Embodiment 1), and temporary curing at 20 [msec] from dot formation increased the first time period T1 to at least 200 [msec]. Similar measurement on a sheet M with a substrate C (Yupo synthesized paper, Lintec) different from the substrates A and B revealed that the first time period T1 was approximately 45 [msec] when the sheet M was subjected to full curing only, and temporary curing at 20 [msec] from dot formation increased the first time period T1 to approximately 100 [msec]. In this way, pinning at an appropriate second ultraviolet irradiation point Pi2 extends the range within which the transportation speed can be chosen.

Looked at from another point of view, pinning allows the first ultraviolet irradiation point Pi1 to be located farther from the dot formation point Pd, thereby increasing the degree of freedom in design. It is also possible to configure the most downstream one of a plurality of ultraviolet irradiation units arranged in the transport direction Ds to serve as the "first ultraviolet irradiation unit 34" and the other ultraviolet irradiation units as the "second ultraviolet irradiation units 35" as in the apparatus described in JP-A-2011-67964. In this case, the most downstream ultraviolet irradiation unit 34 is configured to satisfy the placement and transportation speed conditions described above.

In this embodiment, therefore, the printer 1 corresponds to an example of "an image recording apparatus" according to an aspect of the invention, the sheet M corresponds to an example of "a recording medium" according to an aspect of the invention, the back side of the sheet M corresponds to "one principal surface" according to an aspect of the invention, the front side of the sheet M corresponds to "another principal surface" according to an aspect of the invention, the platen drum 30 corresponds to an example of "a supporting member" according to an aspect of the invention, and the transport direction Ds corresponds to "a transport direction"

according to an aspect of the invention. The ultraviolet irradiation units 34 and 35 correspond to an example of "a first irradiation section" and an example of "a second irradiation section," respectively, according to an aspect of the invention, and ultraviolet radiation corresponds to an example of "radiation" according to an aspect of the invention.

These embodiments should not be construed as limiting any aspect of the invention, and various modifications can be made to the above embodiments without departing from the gist of the invention. For example, although in the above embodiments a cylindrical platen drum 30 is used to hold up and transport a sheet M, the shape of the platen drum 30 is not limited to a cylindrical shape. For example, the platen drum 30 may be shaped like a humpback bridge or into an arc. Furthermore, a certain aspect of the invention can be applied to an image recording apparatus that has a plurality of rollers and a belt therearound instead of the drum 30 and forms ink dots and irradiates the ink dots with ultraviolet radiation in the area over one of the rollers while the belt holds up and transports a sheet M.

In the above embodiments, in which ultraviolet-curable inks are used to record an image, an ultraviolet irradiation unit 34 is used for curing, and an ultraviolet irradiation unit 35 is used for pinning. However, a certain aspect of the invention can be applied to an image recording apparatus in which a radiation-curable ink that cures upon exposure to radiation in a different wavelength range is used. In such a case, irradiation units that emit radiation in that wavelength range are used as an example of "a first irradiation section" and an example of "a second irradiation section," respectively, according to an aspect of the invention instead of the ultraviolet irradiation units 34 and 35.

Furthermore, although in the above embodiments a transparent optical member 344 is provided to cover the aperture, structures that have no such optical member are also possible.

What is claimed is:

1. An image recording apparatus comprising:

a supporting member having a curved surface, the supporting member configured to transport a recording medium in a transport direction while supporting the recording medium with the curved surface;

a head having a nozzle surface having a plurality of nozzles arranged with a certain nozzle pitch and for discharging a radiation-curable ink, the head configured to discharge the radiation-curable ink from the nozzles to the recording medium supported by the curved surface so that the radiation-curable ink forms ink dots;

a first irradiation unit configured to irradiate the ink dots with first radiation at a first irradiation point, the first irradiation point located downstream of a dot formation point at which the ink dots are formed by discharging the radiation-curable ink onto the recording medium; and a control section configured to control a transportation speed of the recording medium transported by the supporting member, the first irradiation unit having a light source configured to generate the first radiation, the first irradiation unit located in a position downstream of the head where the first radiation does not reach the nozzle surface directly and where reflected radiation of the first radiation that is reflected by the supporting member and the recording medium supported by the curved surface does not reach the nozzle surface, wherein a time period from a time immediately after the radiation-curable ink is discharged onto the recording medium to a time when a diameter of the ink dots reaches twice the nozzle pitch is defined as a first time period, the control section configured to control the transportation speed in such a manner that the ink dots formed at the dot formation point move to the first irradiation point in a second time period equal to or shorter than the first time period.

2. The image recording apparatus according to claim 1, further comprising a second irradiation unit located at a second irradiation point and configured to emit second radiation, the second irradiation point located downstream of the dot formation point in the transport direction with a certain distance from the dot formation point and upstream of the first irradiation point in the transport direction with a certain distance from the first irradiation point, wherein an integral dose of the first radiation from the first irradiation unit per unit area of the recording medium is defined as a first integral dose and an integral dose of the second radiation from the second irradiation unit per unit area of the recording medium is defined as a second integral dose, the second integral dose being ⅕ or less of the first integral dose.

3. The image recording apparatus according to claim 2, wherein the light source is controlled in such a manner that the first integral dose of the first radiation given to the ink dots is equal to or more than an integral dose required to stop the ink dots from spreading on the recording medium.

4. The image recording apparatus according to claim 1, wherein the supporting member is a cylindrical drum.

* * * * *